US006253944B1

(12) United States Patent
Osten

(10) Patent No.: US 6,253,944 B1
(45) Date of Patent: Jul. 3, 2001

(54) SPORT LUGGAGE

(76) Inventor: Frederick F. Osten, 11633 239th St., North, Scandia, MN (US) 55073

( * ) Notice: Subject to any disclaimer, the term of this patent is extended or adjusted under 35 U.S.C. 154(b) by 0 days.

(21) Appl. No.: 09/633,014

(22) Filed: Aug. 4, 2000

(51) Int. Cl.[7] ..... B65D 6/28
(52) U.S. Cl. ..... 220/8; 220/4.24; 220/754
(58) Field of Search ..... 220/8, 4.21, 4.24, 220/754, 751, 770

(56) References Cited

U.S. PATENT DOCUMENTS

| | | | | |
|---|---|---|---|---|
| 2,304,896 | * | 12/1942 | Doyle . | |
| 2,416,142 | * | 2/1947 | Bennett . | |
| 2,834,501 | * | 5/1958 | Nutter . | |
| 3,322,262 | * | 5/1967 | Puente . | |
| 3,939,967 | * | 2/1976 | Tenney et al. | 220/4.21 |
| 4,230,234 | * | 10/1980 | Taylor | 220/484 |
| 4,300,612 | * | 11/1981 | Schroeder, Jr. et al. | 206/521 |
| 4,378,866 | | 4/1983 | Pelaavin | 190/52 |
| 4,744,461 | * | 5/1988 | Lapham | 206/5 |
| 5,564,583 | * | 10/1996 | Kelley et al. | 220/23.83 |
| 5,971,119 | | 10/1999 | Chi | 190/108 |
| 6,003,748 | | 12/1999 | Rivenbark | 224/319 |

FOREIGN PATENT DOCUMENTS

| | | | |
|---|---|---|---|
| 682486 | * | 8/1966 | (BE) . |
| 91748 | * | 11/1921 | (CH) . |
| 19659 | * | 10/1891 | (GB) . |

* cited by examiner

*Primary Examiner*—Stephen Castellano
(74) *Attorney, Agent, or Firm*—Jacboson & Johnson

(57) ABSTRACT

The present invention is directed to buoyant, water-resistant sport luggage for various items. The portable sport luggage includes two hollow cylindrical members with their side walls forming conical threads, such that the members may be threaded securely together to form a compartment that provides buoyancy to the sport luggage as well as contain selected utility items. Either one or both hollow cylindrical members may include an apertured tab member with the tab member served to a closed-end member. The apertured tab member is suitable for attaching the portable sport luggage to another object or for use as a lanyard or handle depending on the size of the sport luggage.

9 Claims, 2 Drawing Sheets

SPORT LUGGAGE

FIELD OF THE INVENTION.

The present invention relates to luggage for sport items and, more specifically, to sports luggage that is portable, buoyant and water-resistant that floats sufficiently long without taking on water to allows a user to retrieve the sport luggage should it accidentally fall into the water.

BACKGROUND INFORMATION

The are a great number of luggage containers that are employed for holding a collection of objects of various sizes and shapes. Likewise, a wide variety of materials are used in the fabrication of containers, including, metal, wood, cardboard, glass, plastics and combinations thereof. The materials of construction generally are chosen based upon the characteristics of both the objects contained and the degree of protection afforded by the container.

The concept of sport luggage for holding large items such as fishing rods is illustrated by U.S. Pat. No. 6,003,748 which shows a fishing-rod holder for car top carriers. Still other types of sport luggage or sport bags are shown in U.S. Pat. No. 4,378,866 which shows a multi-compartment sport bag for carrying items, such as clothing and equipment The present invention relates to sport luggage that, in one embodiment, is useful for stowing small items while a person is involved in recreational activities such as fishing, camping, boating, snowmobiling etc. and, in another embodiment, is useful for storing and protecting larger contents from the environment. The present invention comprises sport luggage that is lightweight and water-resistant so that it floats sufficiently long for a person to retrieve it should a person accidentally drop the sport luggage in the water. The sport luggage can be sufficiently small so that a user can carry the sport luggage with him or her by a lanyard attached to the sport luggage or the sport luggage can be larger to accommodate and protect larger articles.

BRIEF DESCRIPTION OF THE PRIOR ART

U.S. Pat. No. 4,378,866 shows a soft-sided, multi-compartment sport bag for carrying items, such as clothing or the like.

U.S. Pat. No. 6,003,748 shows sport luggage for holding a fishing rod on top of a car carrier.

U.S. Pat. No. 5,971,119 shows a luggage case where a primary case and a secondary case are fastened together.

SUMMARY OF THE INVENTION

The present invention is a portable, buoyant, water-resistant sport luggage for various items. The sport luggage includes a first substantially hollow cylindrical member having a closed first end, an open second end and a side wall shaped in the form of a thread so that an outside surface of the side wall has a male thread and an inside surface of the side wall has a female thread. A second substantially hollow cylindrical member is substantially identical to the first cylindrical member, except the second member is larger than the first hollow member. The second member has a tapering side wall, with the thickness of the tapering side wall decreasing from the closed first end to the open second end thereof. The difference size cylindrical members permit threading the second member into the first member, producing a storage compartment therein while a tight, water-resistant connection between the two members inhibits the contents of the storage compartment from becoming wet.

In a further embodiment of the invention, one or both of the closed ends of the cylindrical members include an apertured tab member secured at the closed first end for connecting the sport luggage to another object. In one embodiment a lanyard can be connected thereto and in another embodiment for larger items, a handle can be connected thereto.

The above summary of the present invention is not intended to describe each illustrated embodiment or every implementation of the present invention. The figures and detailed description that follow more particularly exemplify these embodiments.

DESCRIPTION OF THE EMBODIMENT

Figure 1:
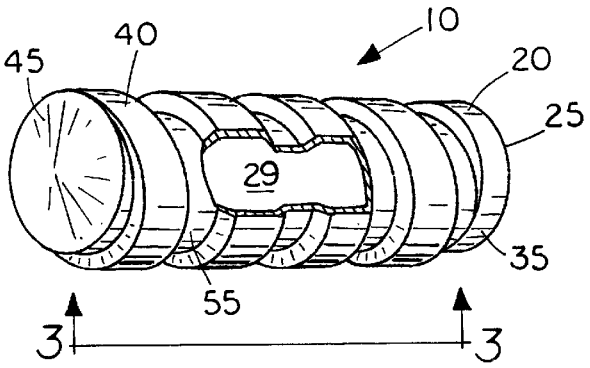
FIG. 1 shows a perspective view of one embodiment of the sport luggage device of the present invention with a portion cut away to reveal an interior compartment.
Figure 2:
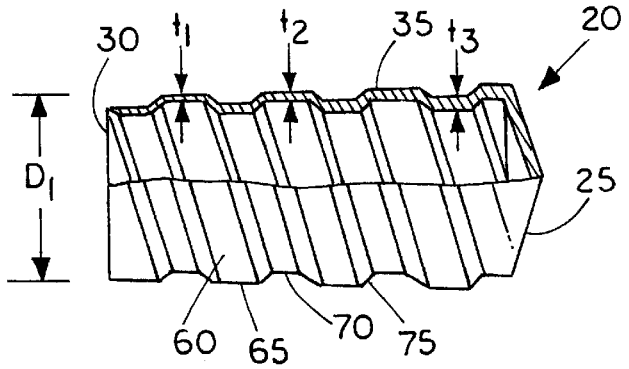
FIG. 2 shows a partial cut-away, section view of the sport luggage device.
Figure 3:
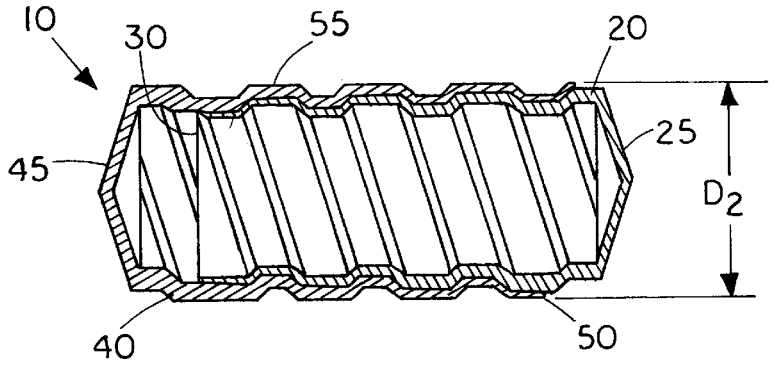
FIG. 3 shows a sectional view of the sport luggage device of FIG. 1.

FIGS. 1–3 show the portable, buoyant, water-resistant sport luggage of the present invention. FIG. 2 shows buoyant sport luggage 10 including a first substantially hollow cylindrical member 20 having a closed first end 25, an open second end 30 and a side wall 35 shaped in the form of a thread so that an outside surface of the side wall has a male thread and an inside surface of the side wall has a female thread.

FIG. 1 shows that the buoyant sport luggage 10 in the assembled condition also includes a second substantially hollow cylindrical member 40 having a closed first end 45, an open second end 50 and a side wall 55 shaped in the form of a thread so that an outside surface of the side wall has a male thread and so that an inside surface of the side wall has a female thread. The second member 40 is substantially identical to the first member 20, except the second member 40 is larger than the first hollow member 20 to permit threading the second member onto the first member. The hollow, cup-shaped cylindrical members 20 and 40 define a storage compartment 29 therein which provides sufficient buoyancy so that sport luggage 10 and utility contents float if accidentally dropped into the water. That is, it should be understood that utility items are those personal items such as keys, clothing, flashlights, tool kits or the like which a user normally carriers from place to place. When such items are placed in the sport luggage, the sport luggage 10 provides sufficient buoyancy to buoyantly support the utility items and the sport luggage, should the sport luggage accidentally fall into the water.

Referring to FIG. 2, the open second end 30 of smaller first member 20 may be defined as having an outer diameter $D_1$. As shown in FIG. 3, the open second end 50 of larger second member 40 may be defined as having an inner diameter of D2 In their unengaged positions, $D_1$ of the first member 20 is less than $D_2$ of the second member 40 to permit the members to threadably engage. Further, the second member 40 has a tapering side wall 55, with a thickness of the tapering side wall 55 decreasing from the closed first end 45 to the open second end 50. Thus, threading the first cylindrical member 20 into the second cylindrical member 40 with tapering side walls 55 produces a tight, water-resistant connection between the two members and prevents disengagement of the two cylindrical members 20 and 40 thereby producing a buoyant, water-resistant sport luggage 10. Consequently, if sport luggage 10 should accidentally fall into the water, the water-resistant connection will provide sufficient resistance to water penetration so that the sport luggage will float for some time thereby enabling the user to retrieve the sport luggage and the contents of the sport luggage.

Referring to FIG. 2, the side wall 35 of the first cylindrical member 20 gradually decreases in thickness from its closed first end 25 to its open second end 30. This tapering is shown by the references symbols $t_1$, $t_2$, $t_3$, which identify the thickness of the side wall 35 at three different circumferential portions, where $t_3$ is greater than $t_2$ which in turn is greater than $t_1$. This tapering aids in permitting a tight, water-resistant seal between the two cylindrical members 20 and 40. It should be noted that the first member 20, including the tapering side wall, is substantially identical to the second member 40 except that the first member 20 is slightly smaller in diameter than the second member 40.

FIG. 2 also illustrates how the thread 60 of either side wall 35 or 55 may be identified by reference to a flat crest 65 and a flat root 70, with the sides 75 of the crest beveled. Preferably, the crest portions 65 of each cylindrical member 20 and 40 are flat to provide comfortable gripping surface. The threaded side walls can be firmly gripped and the hollow cylindrical members 20 and 40 readily tightened or loosened relative to each other.

Further, the thread 60 of the side walls 35 and 55 is conical. The conical thread 60 aids in providing for a tight, water-resistant seal between the two cylindrical member of the sport luggage member 10. The further the members 20 and 40 are threaded together, the tighter the connection between the two members. It should be noted that the side walls 35 and 55 are cylindrical to the human eye. However, the side walls 35 and 55 are slightly conical to provide for the necessary engagement to produce a water-resistant seal for the sport luggage member 10. The mating connection of substantially identical threaded members to provide a water-resistant connection is described in my earlier issued electrical cord connector patents, U.S. Pat. No. 5,505,634 and U.S. Pat. No. 5,772,462, where several types of electrical cord connectors are shown for holding together a male electrical plug and a female electrical plug and such information is herein incorporated by reference.

As mentioned above, the length of the sport luggage member 10 formed from the two hollow cylindrical members 20 and 40 is adjustable. Threading the first member 20 nearly completely into the second member produces a sport luggage member only slightly longer than the second member 40. A longer sport luggage member 10 is available by threading the first member 20 a selected portion of the total possible distance into the second member 40. The length of the sport luggage member 10 is, in fact, infinitely adjustable between total insertion of the first member 20 into the second member 40 and disconnection of the two members 20 and 40.

The hollow cylindrical members 20 and 40 are preferably fabricated from a flexible plastic material such as polyvinyl chloride (PVC) where the threads are molded as an integral part of the side wall. The flexibility of plasticied PVC allows the open end 50 of the larger second hollow cylindrical member 40 to generate a tight seal as the member 40 advances along the smaller first hollow cylindrical member 20 toward the slightly thicker closed end 25 thereof. PVC is available in a variety of colors providing for facile visual location of the sport luggage member 10. The advantage of using PVC is that it enables one to provide a soft-sided sport luggage which can be used to carry small items on a person. That is, the sport luggage can be sufficiently small to fit in the palm of a user's hand or can be made sufficiently large to hold larger items such as clothing; however, in either event, the sport luggage can be provided with the feel of soft sided luggage even though the cylindrical configuration retains its shape.

The buoyant nature of the sport luggage member 10 is particularly useful for boating or fishing applications. For example, in smaller versions, the portable, adjustable, buoyant, water-resistant sport luggage member 10 is suitable for stowing fire-starting matches and fuel, medical supplies, boat keys, or as a tool kit; and in a larger version, the sport luggage 10 is useful for storing larger items such as clothes or the like. The large thread size of the side walls 25 and 55 of the sport luggage member 10 facilitates opening and closing sport luggage member 10 while wearing gloves, mittens or other harsh, winter-weather wear. That is, the thread size is sufficiently large so that only a few turns of the thread extend along the entire length of the cylindrical members. The adjustable length feature allows use of sport luggage 10 to for multiple applications.

Figure 4:
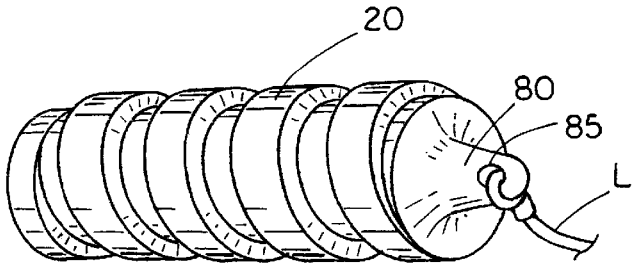
FIG. 4 shows a perspective view of another embodiment of the sport luggage device of the present invention.
Figure 5:
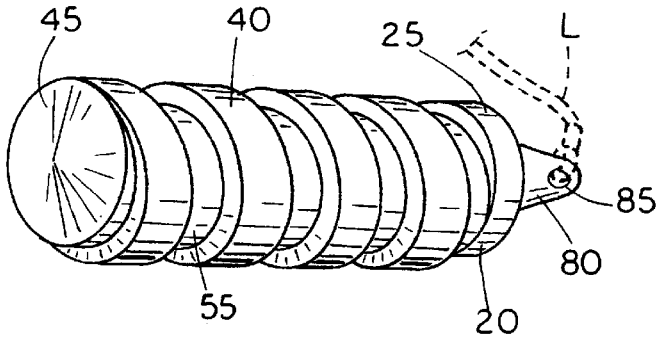
FIG. 5 shows a perspective view of yet another embodiment of the sport luggage device of the present invention.

In a further embodiment of the present invention, as shown in FIG. 4, a tab member 80 is secured to the closed first end of one cylindrical member. The tab member 80 is generally flat, protrudes perpendicularly from the cylindrical member closed first end, and includes an aperture 85 used to secure the sport luggage to another surface, object or handle. For example, FIG. 5 shows a lanyard L may be threaded through the aperture 85 of member 20 for securing to an object with the opposed member 40 having a closed end with no tab member thereon. The rope or lanyard has a loose or free end to enable securing the sport luggage in position such as on a snowmobile or other sports equipment.

Although only one cylindrical member of the two cylindrical members 20 and 40 that make up the sport luggage 10 of the present invention requires an apertured tab 80 for fastening the sport luggage 10 to another object, it may be desirable that both cylindrical members 20 and 40 have an apertured tab so that both cylindrical members for securing to another object, or to each other, to prevent the loss of the non-tethered member.

Figure 6:
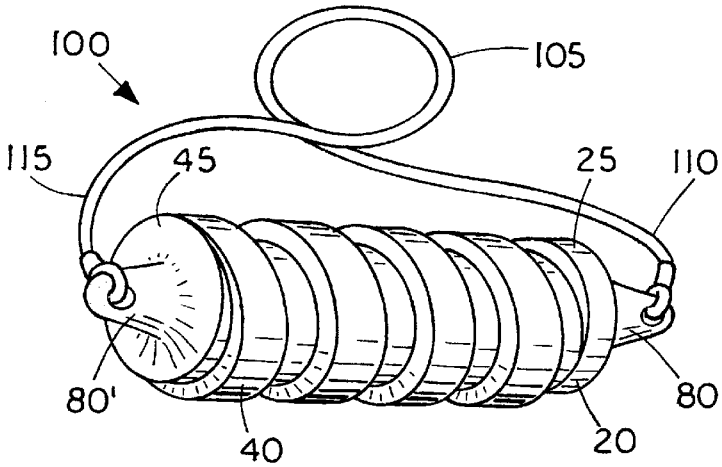
FIG. 6 shows a perspective view of an assembled embodiment of the sport luggage device of the present invention.
Figure 7:
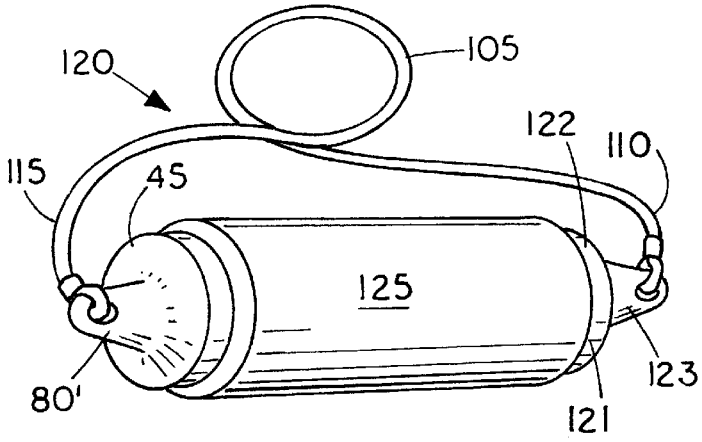
FIG. 7 shows a perspective view of an assembled embodiment of an alternate embodiment of the sport luggage device of the present invention.

FIG. 6 shows sport luggage 100 having cord or lanyard 105 with hollow cylindrical member 20 containing an apertured tab member 80 secured on the first closed end by hollow cylindrical member 40 mated with a hollow cylindrical member 20. A flexible linear connector member or lanyard 105 such as a rope, cable or the like, is fastened at a first end 110 and at a second end 1 15. That is cord 105 has a first end 110 connected to aperture tab 80 and a second end 115 connected to aperture end 80'. The lanyard or cord 105 is sufficient long to allow unthreadng the two hollow cylindrical members 20 and 40 for separation for accessing the contained items within the sport luggage 10, as well as to allow the user to hang the lanyard and the sport luggage 100 around the users neck if the sport luggage is used for small items. On the other hand, if the sport luggage is used for larger items, cord 105 could be replaced with a shoulder strap or the like to provide a support for carrying the sport luggage FIG. 7 shows sport luggage 120 having cord or lanyard 105 with hollow cylindrical member 121 containing an apured tab member 123 secured on the first closed end 122. Attached to hollow member 121 is the second hollow cylindrical member 45 which has external threads that mated with internal threads on hollow cylindrical member 121. In the embodiment of FIG. 7 in contrast to the embodiment of FIG. 6 the threads that appear on the external surface of the member 121 have been filled in to provide a smooth cylindrical surface 125 for placement of graphic or printed information thereon.

What is claimed is:

1. A portable sport luggage comprising:

a first substantially hollow cylindrical member having a closed first end, an open second end and a side wall shaped in the form of a thread so that an outside surface of the side wall has a male thread;

a second substantially hollow cylindrical member substantially identical to the first cylindrical member except the second member has a female thread on an inside surface of a sidewall of the second substantially hollow cylindrical member and a male thread on outside surface of the side wall of the second substantially hollow cylindrical member and is larger than the first hollow member to permit threading the second member onto the first member to produce a storage compartment therein with a length of the storage space defined by the number of turns that the first member is threaded onto the second member so that an item placed in one of the cylindrical members becomes encapsulated by the threading engagement of the other cylindrical member a tab member integrally secured to the closed first end of each of the cylindrical members, each of the tab members having an aperture therein; and a cord extending through the aperture in each of the tab members to secure the sport luggage.

2. The water-resistant port luggage claim 1 wherein the first hollow cylindrical member and the second hollow cylindrical member are made of polyvinyl chloride (PVC).

3. The water-resistant sport luggage of claim 1 wherein the first closed end and the second closed end protrude outward to provide storage space therein.

4. The water-resistant sport luggage of claim 1 wherein the cylindrical member and tab member secured thereto are of one piece.

5. The water-resistant sport luggage of claim 1 wherein each cylindrical member and tab member secured thereto are of one piece.

6. The water-resistant sport luggage of claim 1 wherein each of the side wall is resilient such that it is squeezeable by the hand to have the feel of soft-sided luggage.

7. The water-resistant sport luggage of claim 1 wherein at least one of cylindrical members has an integral tab member secured thereto.

8. The water-resistant sport luggage of claim 1 wherein the second cylindrical member has a smooth cylindrical exterior surface for carrying graphic or printed information thereon.

9. A portable, adjustable, buoyant water-resistant sports sport luggage assembly comprising:

a first substantially hollow cylindrical member having a closed first end, an open second end and said wall shaped in the form of a thread so that an outside surface of the side wall has a male thread in the form of a plurality of partial conical shapes and so that an inside surface of the wall has a female thread in the form of a plurality of partial conical shapes, the first member having a tab member secured to an exterior surface of the closed first end thereof, the tab member having an aperture therein;

a second substantially hollow cylindrical member substantially identical to the first cylindrical member except the second member is lager than the first hollow member to permit threading the second member onto the first member, the second member having a tapering side wall with a thickness of the tapering side wall decreasing from the closed first end to the open second end thereof, the second member having a tab member secured to an exterior surface of the closed first end thereof, the tab member having an aperture therein, whereby threading the first cylindrical member into the second cylindrical member with tapering side wall produces a tight, water-resistant connection between the two members and prevents disengagement of the two members, so that when the two cylindrical members are threadingly joined, they form a compartment to provide a buoyancy to the spo luggage; and a flexible connector member fastened at a first end to one aperture tab and a second end to the other apertured tab member, the connector member of sufficient length to allow separation of the first and second hollow cylindrical members upon unthreading of the two members.

* * * * *